United States Patent [19]

Holterbosch

[11] 3,998,292

[45] Dec. 21, 1976

[54] SCAFFOLD

[75] Inventor: Johan Leo Maria Holterbosch, Utrecht, Netherlands

[73] Assignee: Holterbosch Engineering, B.V., Utrecht, Netherlands

[22] Filed: Aug. 26, 1975

[21] Appl. No.: 607,796

[30] Foreign Application Priority Data

Aug. 29, 1974 Netherlands ..... 7411510

[52] U.S. Cl. ..... 182/128; 182/82; 182/152; 182/130

[51] Int. Cl.[2] ..... E04G 1/36

[58] Field of Search ..... 182/128, 36, 39, 132, 182/130, 104, 84, 152

[56] References Cited

UNITED STATES PATENTS

| | | | |
|---|---|---|---|
| 1,432,116 | 10/1922 | Martin | 182/39 |
| 3,306,396 | 2/ 1967 | Goss | 182/128 |
| 3,870,122 | 3/1975 | Faucheux | 182/128 |

*Primary Examiner*—Reinaldo P. Machado
*Attorney, Agent, or Firm*—Brady, O'Boyle & Gates

[57] ABSTRACT

A scaffold for carrying out activities inside a tank having a substantially cylindrical side wall and a roof with centrally provided therein a manhole, comprising a central mast and, movable therearound, a section for carrying operating platforms rotatably connected to said mast, all scaffold members being coupled for mutual pivotal movement and having such a cross-section that they can be lowered into the tank via the manhole.

6 Claims, 7 Drawing Figures

SCAFFOLD

The invention relates to a scaffold destined to be erected inside a tank, e.g. an oil storage tank, for carrying out activities, such as painting, cleaning and the like, at the inside of the side wall and of the roof. Such oil storage tanks often have a substantially circular-cylindrical side wall and a sloping, or conical or dome-shaped, roof with a manhole in the middle of the roof.

For this purpose there are known several scaffolds. The most widely employed embodiment is the one in which loose pipes and clamps are lowered into the tank via the manhole and from these parts are built scaffolds, which are first arranged along the wall and subsequently, for the treatment of the roof, moved towards the centre of the tank. In particular in larger tanks the scaffold has to be moved a great number of times, which is very time-consuming. When of larger dimensions, the scaffolds must be broad and heavy in order to be stable, so that they can only be moved with difficulty. In general, if the roof of the tank is sloping, the height of the scaffold will have to be adjusted each time it is moved. From the literature there is furthermore known a proposal, according to which a hanging scaffold folded to a flat assembly is lowered through the manhole and unfolded inside the tank in such a way that the hanging scaffold approximately follows the inner contours of the tank. This hanging scaffold could then be rotated, so that the entire inner wall of the tank can be treated successively in circumferential direction. It will be clear that this construction is complicated and expensive, because for the rotation special provisions will have to be made at the manhole and, moreover, the roof of the tank will have to be designed to carry such a construction. Furthermore, such collapsible constructions are mostly adapted to one tank size only.

It is the object of the invention to avoid the above drawbacks. For this purpose there is provided a scaffold for carrying out activities inside a tank having a substantially cylindrical side wall and a roof with centrally provided therein a manhole, which scaffold according to the invention is characterized by a central mast and, movable therearound, a section for carrying operating platforms rotatably connected to said mast, all scaffold members being coupled for mutual pivotal movement and having such a cross-section that they can be lowered into the tank via the manhole. The central mast provides for the centration of the rotating scaffold movement, and the entire scaffold structure rests, respectively moves, on the tank bottom, so that no special requirements are set to the roof of the tank and the scaffold can be mounted inside any existing tank.

Owing to the fact that the scaffold members are coupled for mutual pivotal movement irregularities in the tank bottom or errors in alignment can be smoothed without problems via changes of angle at the pivot points.

A stable scaffold structure consisting of a minimum of members can be obtained if according to the invention the section rotatable about the central mast is composed of columns forming the upright sides of a triangle, which at the top are connected to the mast by means of a beam and at the base by means of substantially horizontal legs. Seen in projection on the tank bottom, the centre of gravity of this scaffold lies always within the triangle formed by a spacer positioned between the bottom ends of the columns and the two legs connecting the bottom ends of the columns to the central mast. This ensures a high stability.

A special aspect of the invention is that the beam connecting the tops of the two columns to the central mast can be placed at such an angle that it extends approximately parallel to the roof of the tank and is designed as a platform. When the scaffold is rotated about the central mast, persons present on this platform beam can successively treat the inner surface of the roof.

As a matter of fact, it will be clear that preferably the plane, in which the two columns extend, is vertical if the tank wall is vertical, so that at the scaffold section formed by these columns there may be attached at desired levels operating platforms, from where the entire inside of the side wall of the tank can be treated.

In an embodiment shown to be effective in practice the platform beam and the horizontal legs may be connected to the mast by means of ball bearing rings.

For the rotation of the scaffold there may be provided roller supports at the bottom ends of the columns, so that upon rotation about the central mast the scaffold can be rolled over the tank bottom, while the ends of the legs and of the platform beam facing the mast rotate about their respective ball bearing rings. It is possible to have at least one of the roller supports driven, e.g. by means of a pneumatic motor.

In case there lie obstacles on the tank bottom, such as heating pipes for controlling the temperature of the stored oil, there may be provided above these obstacles a roller path, along which the rollers at the bottom ends of the columns can move.

One embodiment of the invention will now be described, by way of example, with reference to the accompanying drawings.

Figure 1:
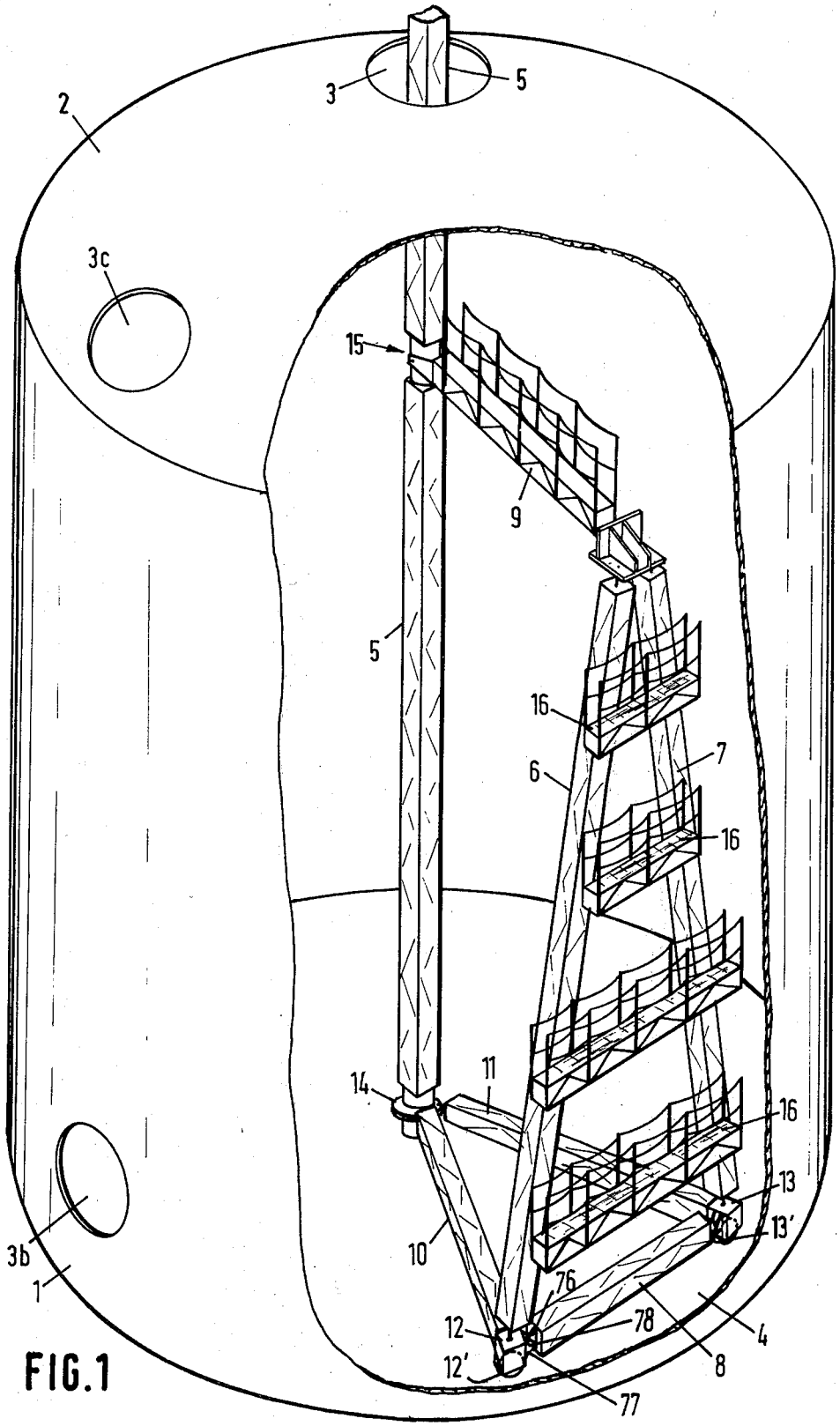
FIG. 1 is a perspective view of the scaffold mounted inside a storage tank, part of which has been cut away.

As is shown in the drawing, the scaffold is mounted inside a tank, e.g. an oil storage tank, having a substantially circular-cylindrical side wall 1 and a conical roof 2 with centrally provided therein a manhole 3. By 4 is indicated the tank bottom. In the preferred embodiment drawn the scaffold consists of a central mast 5 and a substantially triangular section formed by columns 6 and 7, which at the base are connected by a spacer 8, the apex of the triangle formed by members 6, 7 and 8 being connected to central mast 5 by means of a platform beam 9 and the bottom ends of columns 6 and 7 by means of horizontal legs 10 and 11. At the bottom ends of legs 6 and 7 are provided roller supports 12 and 13 for rollers 12' and 13', respectively, by means of which the scaffold can be rolled around central mast 5 over tank floor 4. The ends of horizontal legs 10 and 11 remote from columns 6 and 7 are connected to the central mast by means of a ball bearing ring 14 and the platform beam by means of a ball bearing ring 15.

Central mast 5, columns 6 and 7, legs 10 and 11, and platform beam 9 can be designed as members having such a cross-section that they can be lowered into the tank via manhole 3, e.g. by means of a crane erected outside the tank, where the scaffold can be assembled. Members 5–11 may be designed as lattice members, the largest cross-sectional size of which (e.g. 400 mm) is smaller than the diameter of the manhole (e.g. 600 mm). Furthermore it is possible to compose members 5–11 each of shorter lattice members, for example having a unit size (e.g. 1.20 mm), which are combined to the desired length.

To members 6 and 7 there may be attached at desired levels operating platforms 16 to accommodate employees for treating the tank side wall, while platform beam 9 itself may be designed as an operating platform.

Figure 2:
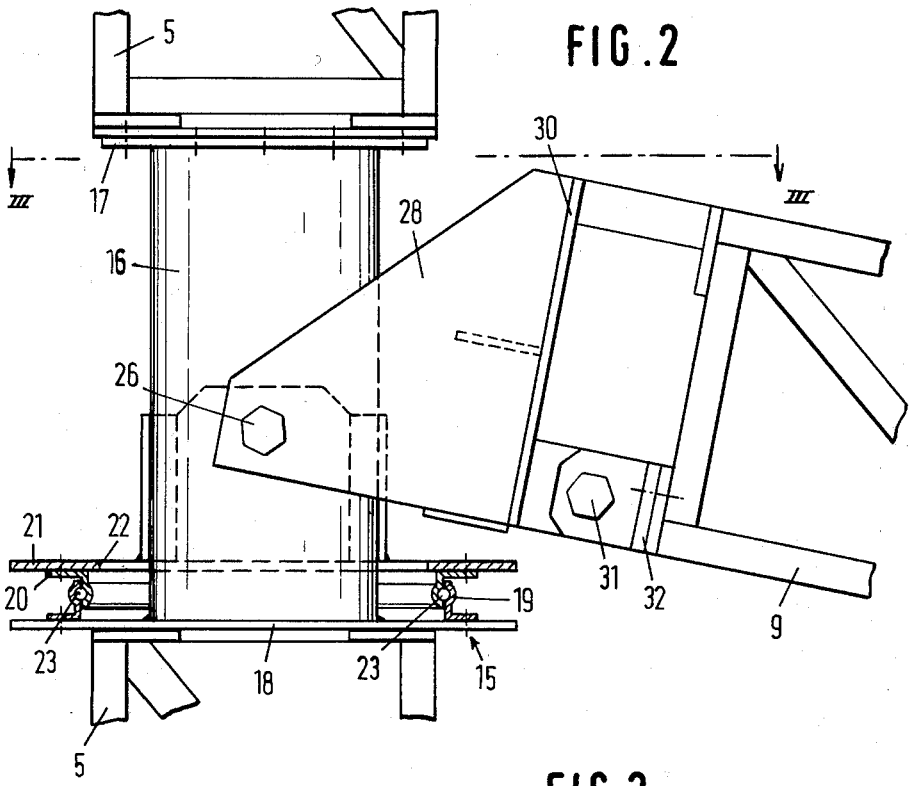
FIG. 2 is a detail side view of the connection of the platform beam to the mast.
Figure 3:
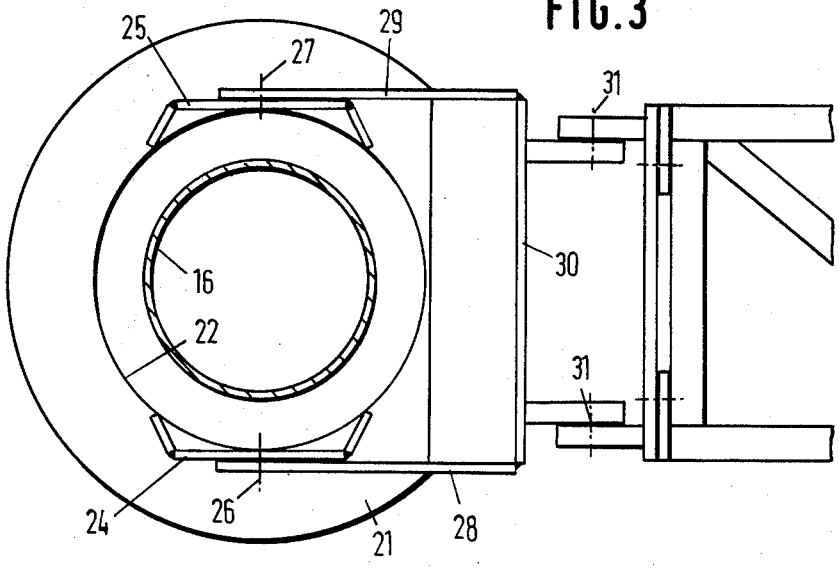
FIG. 3 is a view of the connection on line III—III in FIG. 2.

Detail description of the connection of platform beam 9 to mast 5 (see FIGS. 2 and 3).

Mast 5, composed of lattice members, is interrupted at the connection of beam 9. Between the facing ends of the lattice members there is attached axially a length of pipe 16 by means of end flanges 17 and 18. To flange 18 is attached by means of bolts a half shell 19, which is part of ball bearing ring 15. The other half shell 20 is attached by means of bolts to a flat ring 21 having an inner edge 22, the diameter of which is larger than that of length of pipe 16. Between half shells 19 and 20 there is enclosed a plurality of balls 23. On flange 21 are welded, at either side of the opening of ring 21, cheeks 24 and 25. In cheeks 24 and 25 there are provided holes for passing bolts 26 and 27. By means of these bolts the side plates 28 and 29 of a substantially U-shaped bracket, composed of side plates 28, 29 and a base plate 30, can be so attached that the bracket can swing about a horizontal axis through bolts 26 and 27. To base plate 30 is attached beam 9 by means of lips welded at the base plate and at said beam end and bolts 31, while including an end plate 32 at the end of beam 9.

Figure 5:
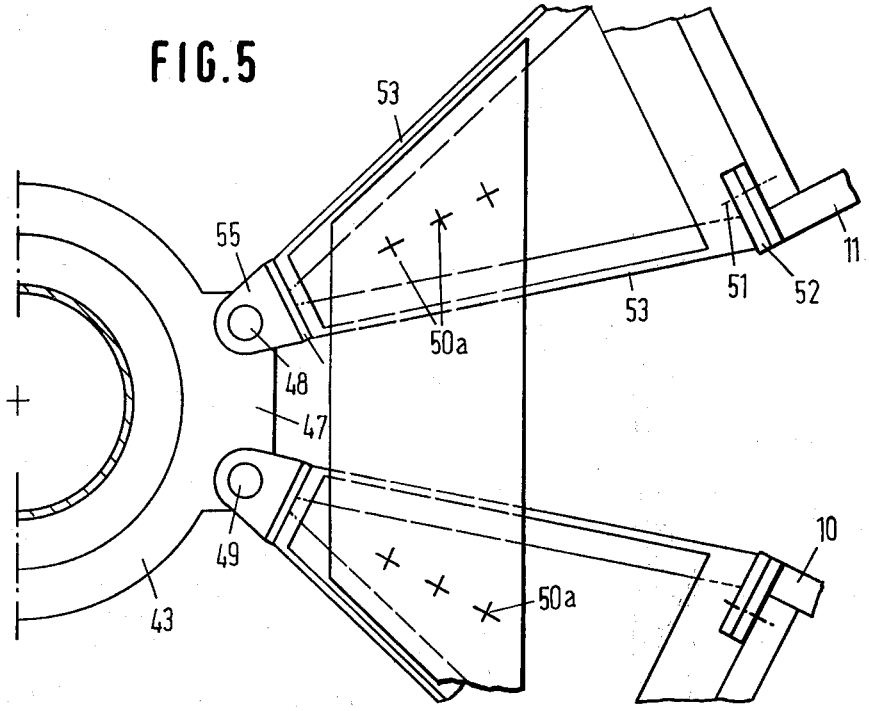
FIG. 5 is a top view of the connection, substantially on line V—V.
Figure 4:
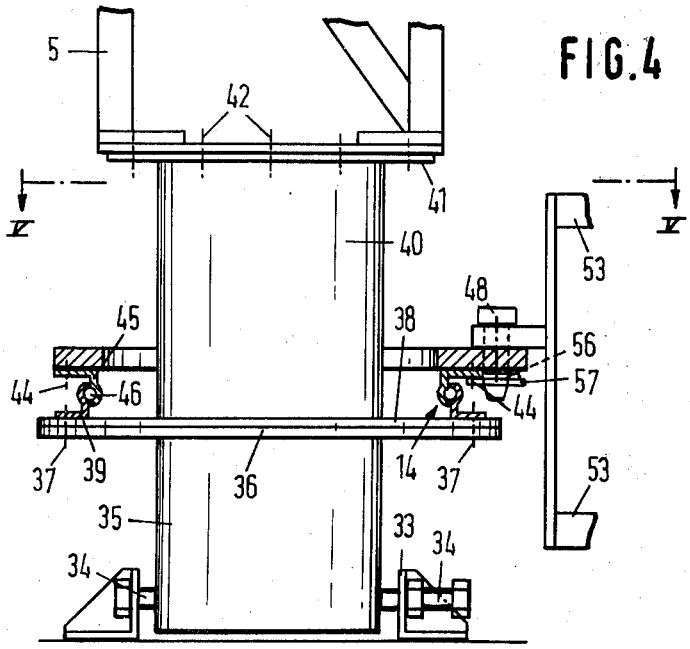
FIG. 4 is a detail side view of the connection of the legs to the mast.

Detail description of the bearing at the bottom end of mast 5 and connection thereto of legs 10 and 11 (see FIGS. 4 and 5).

For centring the bottom end of central mast 5 there is fixed a ring 33 on the bottom of tank 1. By means of bolts 34 a length of pipe 35 can be centred inside ring 33. On the upper end of length of pipe 35, which forms the real foot of mast 5, is welded a flange 36. By means of bolts 37 there is attached a flange 38, with thereon a half shell 39, to flange 36. Flange 38 is welded onto a length of pipe 40, which at the other end is attached by means of an end flange 41 and bolts 42 to the connecting lattice portion of mast 5.

To a flat ring 43 having a diameter larger than that of length of pipe 40 there is attached by means of bolts 44 a half shell 45. Half shells 39 and 45 together enclose a plurality of balls 46 with formation of ball bearing ring 14.

Flat ring 43 is provided with a radially extending lip portion 47 having two holes for receiving swivel bolts 48 and 49.

Since the following part of the specification relating to the connection of leg 11 with swivel bolt 48 would be identical to that in respect of the connection of leg 10 with swivel bolt 49, only the former connection will be described. Leg 11 is provided with an end plate 50, at the upper and lower edges of which are attached by means of bolts 51 base plates 52 of substantially triangular brackets, the upright sides of which are formed by angle sections 53, which at the top merge into a strip 54 common to the two brackets. At right angles to strip 54 there is formed a lug 55 having a hole, through which extends swivel bolt 48. Swivel bolt 48 is provided with a groove 56 for receiving a snap ring 57, which prevents the loosening of the bolt.

Figure 6:
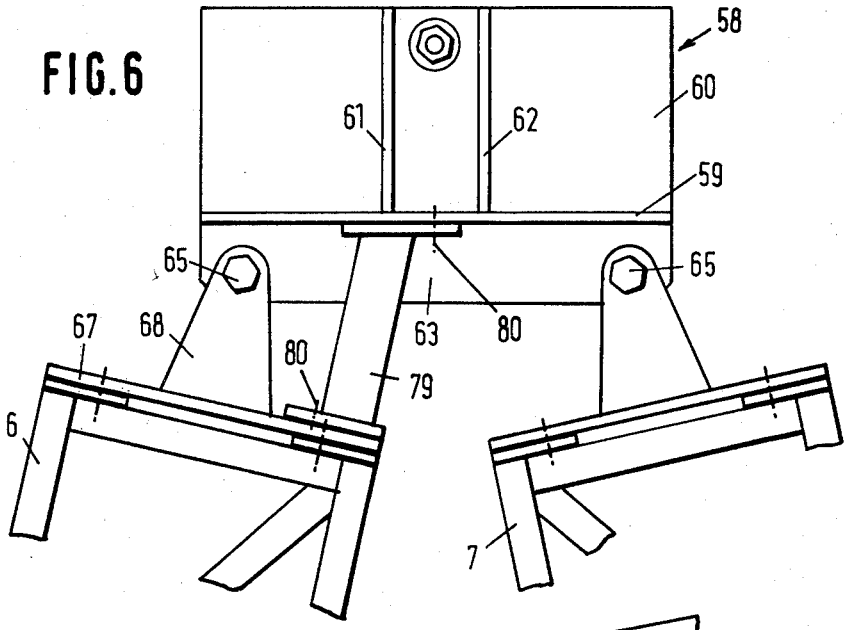
FIG. 6 is a detail view of the connection of the columns to the platform beam, substantially according to arrow P in FIG. 1.
Figure 7:
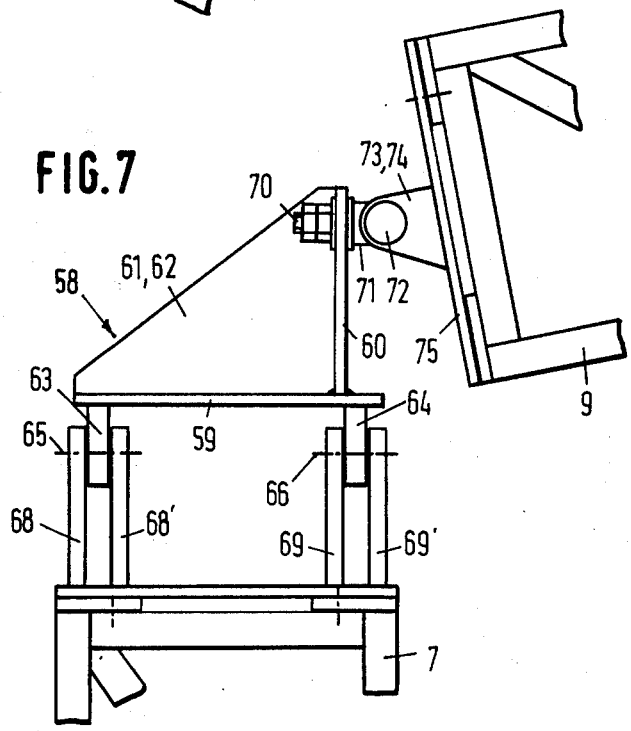
FIG. 7 is a side view of the connection according to FIG. 6.

Detail description of the connection of columns 6 and 7 to platform beam 9 (see FIGS. 6 and 7).

Beam 9 is connected to the top of columns 6 and 7 by means of a coupling piece 58 substantially consisting of an assembly of plates 59 and 60 welded at right angles to each other, and stiffened by stays 61 and 62 welded at the two plates 59 and 60 at right angles therewith and positioned at either side of the middle thereof. At the bottom of plate 59 there are welded two parallel strips 63 and 64. Each of strips 63 and 64 is provided with two holes for receiving bolts 65 and 66, respectively. Column 6 is provided with an end plate 67 with welded thereon two pairs of lugs 68, 68′ and 69, 69′, respectively. In each pair of the spacing between the lugs is wider than the thickness of strips 63 and 64. Lugs 68, 68′ are attached to strip 63 by means of a bolt 65 and lugs 69, 69′ to strip 64 by means of a bolt 66.

Since a description of the connection of leg 7 to coupling piece 58 would mean a repetition of the preceding, it is not given.

In plate 60 coupling piece 58 is provided with a hole for attaching thereto a lug 71 by means of a bolt 70. Through the lug extends a swivel bolt 72 which connects two lips 73, 74 to lug 71. Lips 73, 74 are attached to an end plate 75, which is connected to the end of beam 9 facing coupling piece 58 by means of bolts.

From the above description of the connections of mast 5 to platform beam 9 and to legs 10 and 11, and of the connection of the lugs of legs 6 and 7 to beam 9, it will be clear that the scaffold members are so flexibly interconnected that with preservation of sufficient stability upon rotation of the scaffold about mast 5 rollers 12′ and 13′ can move conveniently over irregularities on tank bottom 4. Rollers 12′ and 13′ are mounted in blocks 12 and 13, respectively, which are rigidly attached to legs 10 and 11, respectively. The axes of rotation of rollers 12′ and 13′ lie substantially according to the centre lines of legs 10 and 11, respectively, so that the rollers can move along a substantially circular path about the ball bearing ring as the centre.

Blocks 12 and 13 are connected by means of spacer 8, which for that purpose at each end is provided with a lug 76. Each of blocks 12 and 13 is also provided with a lug 77. Through lugs 76 and 77 extends a bolt 78.

All parts of the scaffold have such dimensions that, either separately or already partly assembled outside the tank, they can be lowered into the tank via manhole 3. By means of bolt connections the various scaffold components can be assembled inside the tank and, after completion of the activities, such as painting, blasting and the like, the scaffold can be disassembled to members having a size sufficiently small to be hoisted up via the manhole. By composing mast 5, columns 6 and 7, legs 10 and 11, spacer 8 and beam 9 of lattice members having a specific unit size, e.g. 1.20 m, the scaffold dimensions can be adapted to different tank sizes in a simple manner.

It will be clear that within the scope of the invention several modifications are possible. For example, in particular in tanks having a larger diameter there can be mounted two or more rotatable sections about the central mast, so that the activities can be carried out at a number of places simultaneously.

I claim:

1. A free standing scaffold for carrying out activities inside a tank having a substantially cylindrical side wall and a roof with a manhole centrally provided therein, comprising a central mast supported only on the bottom of the tank, a scaffold section for carrying operating platforms rotatably connected to said central mast for movement therearound and composed of a pair of upwardly converging columns forming the upright sides of a triangle, a laterally extending beam pivotally connected at one end to the tops of said pair of columns and rotatably and pivotally connected at the other end to said central mast, and a pair of radially extending legs respectively pivotally connected at one end to the bottom portions of said pair of columns and rotatably and pivotally connected at the other end to said central mast, means connected to the bottom portions of said pair of columns movably supporting said scaffold section on the bottom of the tank and stabilizing said central mast, all of said scaffold members being connected together for mutual pivotal movement and each having cross-sectional dimensions less than the diameter of the manhole, whereby the scaffold members can be lowered into the tank via the manhole and assembled into the free standing scaffold inside the tank.

2. A free standing scaffold as set forth in claim 1, including a spacer member extending between and pivotally connected to the bottom portions of said pair of columns, said pair of radial legs and said spacer member connected to form a substantially horizontally disposed triangle.

3. A scaffold as set forth in claim 1, in which said laterally extending beam extends approximately parallel to the roof of the tank and is designed as a work platform.

4. A scaffold as set forth in claim 1, in which said laterally extending beam and the pair of radial legs are connected to the mast by means of ball bearing rings.

5. A free standing scaffold as set forth in claim 1 in which said means connected to the bottom portions of said pair of columns comprise roller supports having roller axes respectively parallel with the longitudinal axes of the corresponding pair of radial legs.

6. A free standing scaffold as set forth in claim 5 including motor drive means connected to drive at least one of said roller supports.

* * * * *